US006343648B1

(12) United States Patent
Carmichael et al.

(10) Patent No.: US 6,343,648 B1
(45) Date of Patent: Feb. 5, 2002

(54) DOWN-HOLE TOOL WITH DETACHABLE CLEANING PADS

(75) Inventors: Mark Carmichael, Aberdeenshire; Paul Howlett, Aberdeen, both of (GB)

(73) Assignee: Specialised Petroleum Services Limited, Westhill (GB)

( * ) Notice: Subject to any disclaimer, the term of this patent is extended or adjusted under 35 U.S.C. 154(b) by 0 days.

(21) Appl. No.: 09/337,665

(22) Filed: Jun. 22, 1999

(30) Foreign Application Priority Data

Jun. 23, 1998 (GB) ..... 9813422

(51) Int. Cl.[7] ..... B08B 9/04; E21B 37/02

(52) U.S. Cl. ..... 166/173; 15/104.05; 15/104.16; 166/170; 166/311; 175/325.4

(58) Field of Search ..... 166/170, 172, 166/173, 174, 176, 177.3, 311, 312; 15/104.2, 104.16, 104.05, 104.31, 104.061; 175/325.1, 325.4, 325.5, 326

(56) References Cited

U.S. PATENT DOCUMENTS 4,798,246 A * 1/1989 Best ..... 166/311
5,167,279 A * 12/1992 Stafford ..... 166/171
5,711,046 A * 1/1998 Potter ..... 15/104.2
5,819,353 A * 10/1998 Armell et al. ..... 15/104.2
5,868,212 A * 2/1999 McManus ..... 175/325.4

FOREIGN PATENT DOCUMENTS

GB 2171436 A * 8/1986

* cited by examiner

*Primary Examiner*—David Bagnell
*Assistant Examiner*—Jennifer H Gay
(74) *Attorney, Agent, or Firm*—Fleshner & Kim, LLP

(57) ABSTRACT

A down-hole tool for use in an oil or gas well is provided with detachable components that are held to a body or tool housing by longitudinal mechanical fasteners disposed in a generally radial orientation. The mechanical fasteners allow for the components to be quickly removed and refurbished or replaced, while also permitting radial movement or floating of the components during operation of the tool. A spring may be incorporated to bias the components in a radial outward direction during operation.

14 Claims, 2 Drawing Sheets

DOWN-HOLE TOOL WITH DETACHABLE CLEANING PADS

BACKGROUND OF THE INVENTION

1. Field of the Invention

This invention relates to equipment intended for use in down hole environments, such as may typically be found in oil and gas wells. The invention has a particular application in connection with well casing cleaning apparatus.

2. Background of the Related Art

In U.S. Pat. No. 5,711,046, there is described well cleaning apparatus which has a body member to which is attached, preferably, a plurality of cleaning pads spaced circumferentially around the body member. The pads are provided with bristles on their outer face and are biased outwardly by coil springs or similar means in an attempt to maintain a sufficient contact pressure of the bristles on the interior wall of the casing.

British Patent Number GB 2,295,632 describes an alternative brushing tool which incorporates bristles that protrude from raised rib-like portions on a body member.

An alternative well clean up tool is generally known as a casing scraper. This type of tool typically incorporates casing scraper blades that scrape the inside of the casing or tubing in the well. The steel blades may also be mounted on detachable pads, plates or the like.

SUMMARY OF THE INVENTION

An object of the present invention is to provide an improved means of retaining pads supporting brushes, scraper blades or the like.

There are several operations performed down-hole that may lead to the wear or damage of particular components of a tool. The present invention therefore recognizes that it would be advantageous to design a means for the easy and cost efficient replacement or repair of such components. An object of the present invention therefore is to provide certain components prone to premature wear or damage in a manner which allows them to be detached from the main body of the tool. Moreover, a related and yet further object is to provide an improved retaining means for retaining detachable components or consumables to the body of a respective down-hole tool.

The retaining means should allow for the convenient and efficient removal and replacement of a component or consumable, while also allowing for the effective use and operation of the component during the normal operation of the tool.

An example of the type of component that has been found advantageous to retain in a detachable manner is a pad used to support bristles on a casing brush. A casing brush or brushing tool as it is also known in the industry is a type of well clean up tool, designed for producing a clean interior in the casing or liner of the drilling well. The pads support a bed of wire bristles and are typically biased outwardly by compression springs or the like that cause the bristles to bear forcibly on the casing wall. The pressure of the pads on the casing lead to the wear of the bristles and warrants bristle replacement or repair.

According to the present invention, there is provided a down-hole tool comprising a generally tubular body member and one or more detachable pads, the one or more pads each being retained to the body member by a retaining means provided as a plurality of longitudinal mechanical fasteners disposed in generally radial orientation in use and positioned so as to correspond with and pass through respective apertures provided in the pads, wherein the mechanical fasteners each engage the body member and limit the radial movement of the pad away from the body member.

Preferably each pad is provided with a said aperture in the vicinity of each of its corners and is retained in use to the body member by a mechanical fastener at each said aperture.

Typically the mechanical fasteners are bolts or threaded rods. They may be formed with a bolt head or may be associated with retaining nuts or the like. The apertures may be countersunk on the outer face of the pad to provide a recess for the bolt head or retaining nut.

The tool may further include biasing means for biasing the or each pad in an outward radial direction, wherein the biasing means comprise springs held under compression in use.

The springs may be coil springs or leaf springs for example. Preferably, where the springs are provided as coil springs, some or all of the springs may be located over the mechanical fasteners. In any event, the springs are preferably located toward the peripheral edges of the pad. This has the advantage of promoting an even or balanced outward bias on the pad.

Typically, the pads support one or more cleaning members on their outer face for cleaning casing strings. The cleaning members may be bristles or scraper blades for example.

BRIEF DESCRIPTION OF THE DRAWINGS

In order to provide a better understanding of the invention, example embodiments will now be described with reference to the accompanying figures, in which.

DETAILED DESCRIPTION OF PREFERRED EMBODIMENTS

Figure 1:
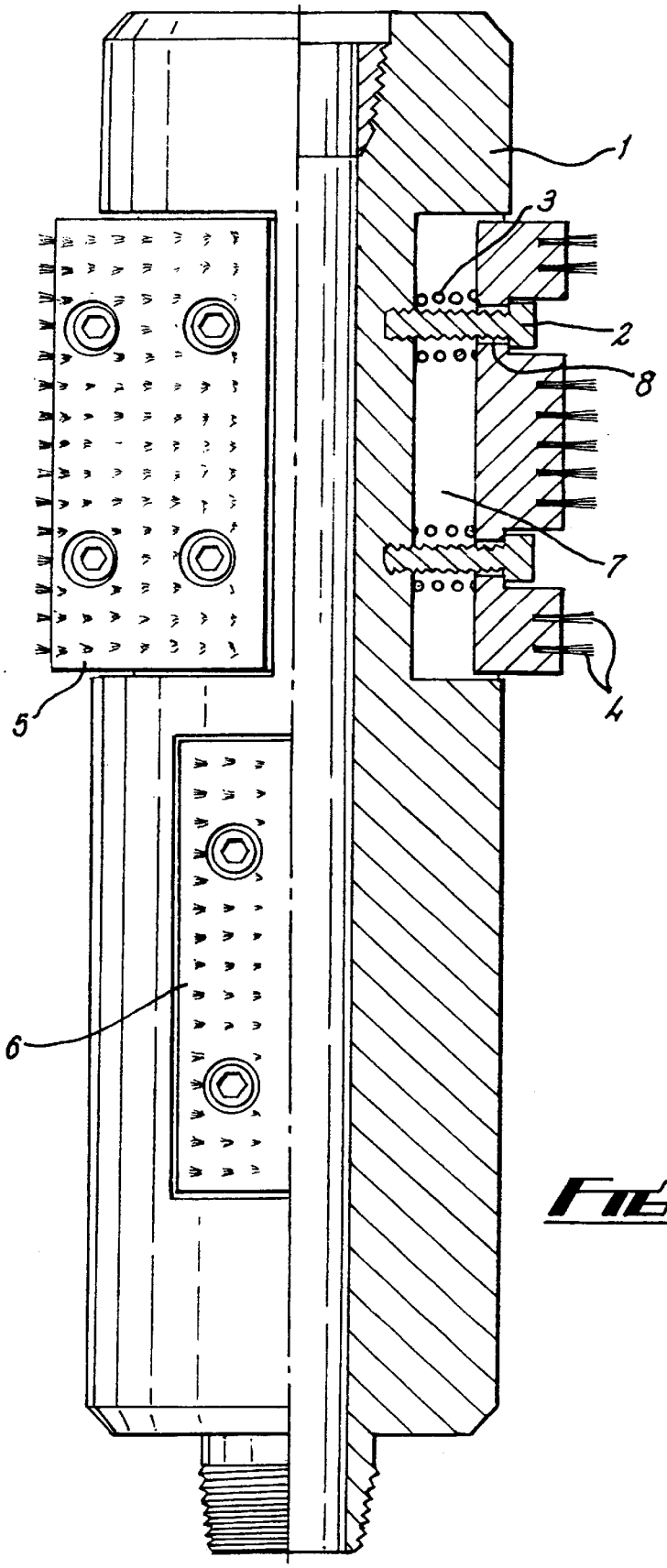
FIG. 1 shows a downhole tool supporting three cleaning pads, the cleaning pads bearing respective brushes for brushing a well casing.

Referring firstly to FIG. 1, a down-hole tool attachable to a work string comprises a generally cylindrical body member 1 which incorporates three receptacles 7 for locating detachable cleaning pads 5. The pads 5 support a bed of bristles 4 for brushing the inside wall of a casing string or other well tubing (not shown).

The pads 5 are held in position in respective receptacles by retaining means, including four bolts 2. The head of the bolts 2 are positioned outwardly in a radial direction, with the shank of the bolts 2 being inserted through respective apertures 8 in the pads 5 and engaging female threaded bores in the body member 1.

It may be seen that the bolt heads nest in the countersunk cavities of the apertures 8. In this way the bolt heads do not protrude beyond the outer face of the pads 5, ensuring they do not foul on the casing wall.

The pads 5 are biased in an outward radial direction by the coil springs 3. The springs 3 are located over the bolts 2 and provide a compressive force between the body member 1 and the inner face of the pads 5. One advantage of the springs being placed over the bolts 2 lie in the fact that the springs are not easily removed from the tool during use. The present invention recognizes that the dislodgement or inadvertent removal of the springs is extremely contrary to the overall purpose of the tool.

Yet further, the positioning of the springs 3 in close association with the mechanical fasteners serves to tighten the fasteners 2 or more specifically the thread tension, together with the interface between the bolt head and the pads. Although not clearly shown in FIG. 1, tension nuts may be provided between the bolt head and the pad 5 to act against the compressive force of the spring 3 when it is desired to remove a pad 5 from the tool body member 1. The tension nuts preferably would be of greater diameter than the bolt heads to ensure easy access to them.

The bolts 2 are each positioned in the vicinity of a respective corner of the pad 5. This has the advantage of maintaining the pads 5 in a balanced state, whereby they address the casing wall squarely and not in a tilted manner as may be the case where the pads are retained in their middle or at only one or two edges thereof.

The pads 5 and 6 are provided over two rows on the body member 1; there being provided a bypass area between each pad for circulation purposes in the well. Typically, the pads 5 on the first row are circumferentially offset from the pads 6 on the second row.

Figure 2:
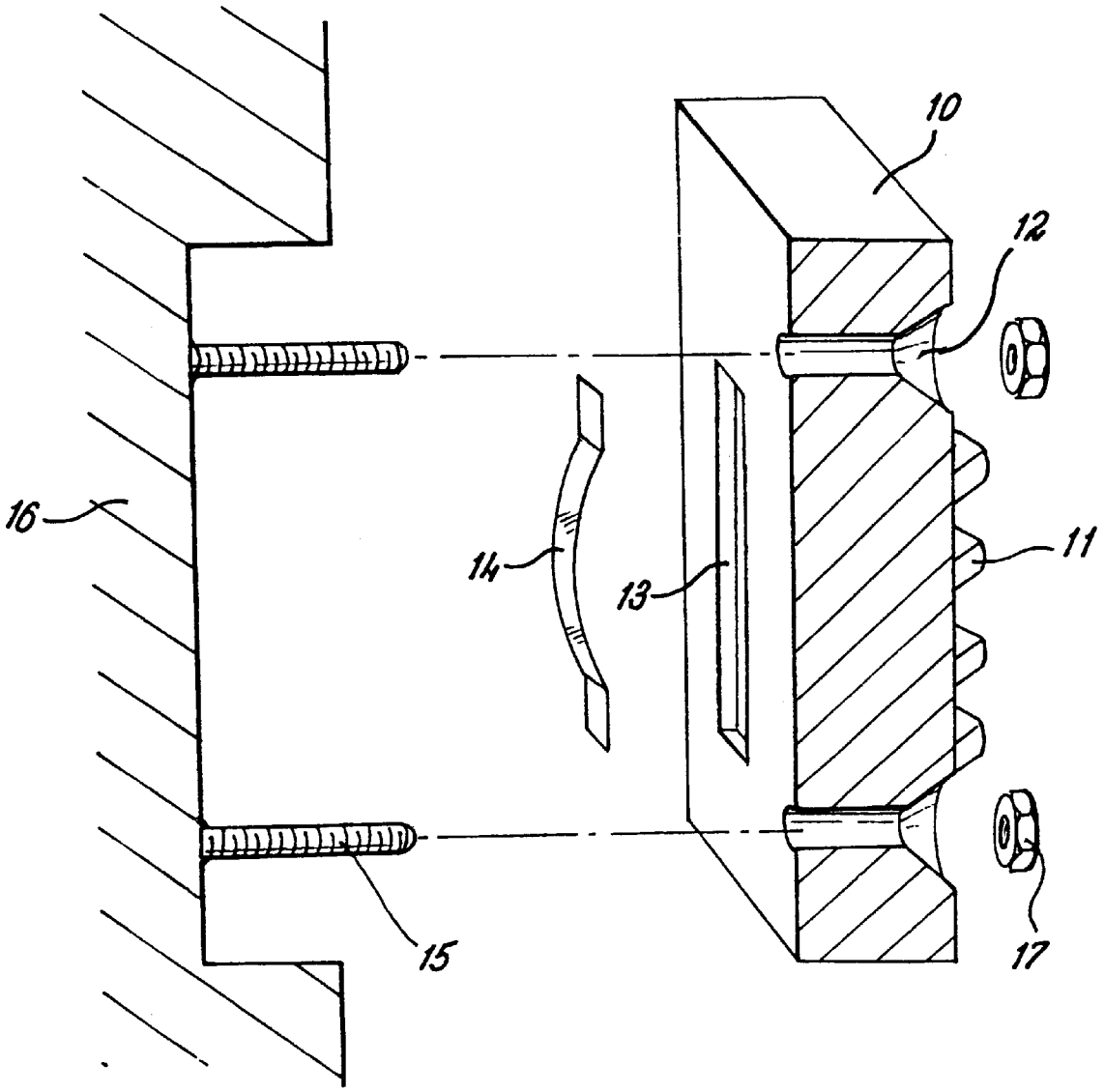
FIG. 2 shows an exploded view of an alternative pad and retaining means removed from the tool body.

Turning now to FIG. 2, there is shown an exploded sectional view of an alternative pad 10, the pad supporting casing scraper blades 11. As before, the pad 10 is provided with four countersunk apertures 12, located generally at the four corners of the pad 10.

However, the pad 10 is provided with two spring seats 13 for locating biasing means in the form of leaf springs 14. The seats 13 are again positioned generally adjacent to the perimeter or edges of the pads.

The retaining means illustrated in FIG. 2 consist of a plurality of threaded rods 15 that are permanently fixed to the body member 16 at one end. The free end of the rods 15 are adapted to be inserted through the apertures 12 of the pad 10 such that the pad 10 may be secured to the body member 16 by threading on to the rods 15 the retaining locking nuts 17.

A further advantage of the invention is that the inadvertent features or breakage of one of the mechanical fasteners does not lead to the total redundancy of the associated pad; the other mechanical fasteners serving to continue to retain the pad in position and allow for its continued performance.

In the embodiments shown, the pads may be simply and quickly removed from the body member of the tools by unscrewing the bolts or retaining nuts.

Further modifications and improvements may be incorporated without departing from the scope of the invention herein intended.

What is claimed is:

1. A down-hole tool, comprising:

a generally tubular body member; and one or more detachable pads mounted on the tubular body member so that they are radially movable, the one or more pads each being retained to the body member by a retaining means provided as one or more longitudinal mechanical fasteners disposed in a generally radial orientation and positioned so as to correspond with and pass through respective apertures provided in the pads, wherein the one or more mechanical fasteners each engage the body member and limit the radial movement of the pad away from the body member; and biasing means for biasing the or each pad in an outward radial direction, wherein the biasing means comprise springs held under compression when the down-hole tool is in use, the springs are coil springs, and some or all of the springs may be located over the mechanical fasteners.

2. The down-hole tool as claimed in claim 1, wherein each pad is provided with apertures in the vicinity of each of its corners and is retained to the body member by a mechanical fastener in each said aperture.

3. The down-hole tool as claimed in claim 1, wherein the mechanical fasteners are bolts or threaded rods.

4. The down-hole tool as claimed in claim 3, wherein the one or more mechanical fasteners are formed with a bolt head or are adapted to engage with retaining nuts.

5. The down-hole tool as claimed in claim 4, wherein the apertures are countersunk on the outer face of the pad to provide a recess for the bolt head or retaining nut.

6. The down-hole tool as claimed in claim 1, wherein the springs are located toward peripheral edges of the pad.

7. The down-hole tool as claimed in claim 1, wherein the pads support one or more cleaning members on their outer face for cleaning casing strings.

8. The down-hole tool as claimed in claim 7, wherein the cleaning members are bristles or scraper blades.

9. The down-hole tool as claimed in claim 1, wherein the longitudinal mechanical fasteners comprise bolts, and further comprising one or more tension nuts provided between the mechanical fasteners and the pads to act against the compressive force of the spring.

10. The down-hole tool as claimed in claim 9, wherein the tension nuts would be of a greater diameter than the bolt heads.

11. A down-hole tool, comprising:

a main body member;

a plurality of pads that are movably mounted on the main body member, wherein each pad has at least one aperture passing therethrough;

a plurality of longitudinal retaining members, wherein each longitudinal retaining member passes through an aperture of one of the plurality of pads and is attached to the main body member, and wherein the longitudinal retaining members limit radial movement of the pads relative to the main body member; and biasing means for biasing the plurality of pads in an outward radial direction, wherein the biasing means comprise springs held under compression when the down-hole tool is in use, the springs are coil springs, and some or all of the springs may be located over the mechanical fasteners.

12. The down-hole tool of claim 11, wherein the apertures in the pads and the plurality of longitudinal retaining members are configured such that when the pads are moved adjacent the main body member, the longitudinal retaining members do not protrude beyond the pads.

13. A cleaning tool, comprising:

a generally tubular body member;

one or more detachable pads, mounted on the tubular body member so that they are radially movable, the one or more pads each being retained to the body member by a retaining means provided as one or more longitudinal mechanical fasteners disposed in a generally radial orientation and positioned so as to correspond with and pass through respective apertures provided in the pads, wherein the one or more mechanical fasteners each engage the body member and limit the radial movement of the pad away from the body member, and wherein the one or more detachable pads are cleaning members configured to clean interior walls of a well bore; and biasing means for biasing the or each pad in an outward radial direction, wherein the biasing means comprise springs held under compression when the down-hole tool is in use, the springs are coil springs, and some or all of the springs may be located over the mechanical fasteners.

14. The cleaning tool as claimed in claim 13, wherein the one or more detachable pads are one of cleaning brushes and scrapers.

* * * * *